US007640988B2

(12) United States Patent
Phi et al.

(10) Patent No.: US 7,640,988 B2
(45) Date of Patent: Jan. 5, 2010

(54) HYDRAULICALLY CONTROLLED BURST DISK SUBS AND METHODS FOR THEIR USE

(75) Inventors: Manh V. Phi, Houston, TX (US); Pin Y. Huang, Houston, TX (US); Michael D. Murrey, The Woodlands, TX (US)

(73) Assignee: Exxon Mobil Upstream Research Company, Houston, TX (US)

( * ) Notice: Subject to any disclaimer, the term of this patent is extended or adjusted under 35 U.S.C. 154(b) by 0 days.

(21) Appl. No.: 11/883,285

(22) PCT Filed: Feb. 10, 2006

(86) PCT No.: PCT/US2006/004967

§ 371 (c)(1),
(2), (4) Date: Jul. 30, 2007

(87) PCT Pub. No.: WO2006/101618

PCT Pub. Date: Sep. 28, 2006

(65) Prior Publication Data

US 2008/0156498 A1 Jul. 3, 2008

Related U.S. Application Data

(60) Provisional application No. 60/663,216, filed on Mar. 18, 2005.

(51) Int. Cl.
*E21B 43/25* (2006.01)

(52) U.S. Cl. ..... 166/307; 166/374; 166/376; 166/317

(58) Field of Classification Search ..... 166/307, 166/376, 317, 374
See application file for complete search history.

(56) References Cited

U.S. PATENT DOCUMENTS

| | | | |
|---|---|---|---|
| 1,569,293 | A | 1/1926 | Miller |
| 3,637,020 | A | 1/1972 | McLamore |
| 3,831,680 | A | 8/1974 | Edwards et al. |
| 4,039,031 | A | 8/1977 | Crowe |
| 4,754,811 | A | 7/1988 | Ledent et al. |
| 4,949,788 | A | 8/1990 | Szarka et al. |
| 4,949,793 | A | 8/1990 | Rubbo et al. |

(Continued)

FOREIGN PATENT DOCUMENTS

WO WO 03/056131 A1 7/2003

OTHER PUBLICATIONS

C. W. Crowe, "Chapter 17: Principles of Acid Fracturing", *Reservoir Stimulation*, 1989, pp. 17-1-17-12, Second Edition, Prentice Hall, New Jersey.

(Continued)

*Primary Examiner*—David J Bagnell
*Assistant Examiner*—Robert E Fuller

(57) ABSTRACT

A method and apparatus for treating a subterranean section surrounding a wellbore with a fluid. In one embodiment, the apparatus comprises a three-dimensional tubular element capable of fluid flow in a wellbore with at least one burst disk with a pre-determined pressure rating positioned at a desired location on the tubular wherein the burst disk ruptures at the pre-determined pressure at the desired location on the tubular in the wellbore. The method provides the ability to choose the order in which the subterranean interval sections surrounding a wellbore are treated with fluid.

5 Claims, 5 Drawing Sheets

U.S. PATENT DOCUMENTS

| | | | |
|---|---|---|---|
| 5,005,649 | A | 4/1991 | Smith et al. |
| 5,044,444 | A | 9/1991 | Coronado |
| 5,145,005 | A | 9/1992 | Dollison |
| 5,156,207 | A | 10/1992 | Haugen et al. |
| 5,165,478 | A | 11/1992 | Wilson |
| 5,170,844 | A | 12/1992 | George et al. |
| 5,320,178 | A | 6/1994 | Cornette |
| 5,355,956 | A | 10/1994 | Restarick |
| 5,392,862 | A | 2/1995 | Swearingen |
| 5,472,052 | A | 12/1995 | Head |
| 5,765,641 | A | 6/1998 | Shy et al. |
| 5,810,087 | A | 9/1998 | Patel |
| 5,950,733 | A | 9/1999 | Patel |
| 5,954,135 | A | 9/1999 | Williamson et al. |
| 6,026,903 | A | 2/2000 | Shy et al. |
| 6,047,773 | A | 4/2000 | Zeltmann et al. |
| 6,050,336 | A | 4/2000 | Willauer et al. |
| 6,173,795 | B1 | 1/2001 | McGarian et al. |
| 6,176,307 | B1 | 1/2001 | Danos et al. |
| 6,189,618 | B1 | 2/2001 | Beeman et al. |
| 6,263,968 | B1 | 7/2001 | Freeman et al. |
| 6,286,594 | B1 | 9/2001 | French |
| 6,334,488 | B1 | 1/2002 | Freiheit |
| 6,408,946 | B1 | 6/2002 | Marshall et al. |
| 6,533,038 | B2 | 3/2003 | Venning et al. |
| 2003/0037926 | A1 | 2/2003 | Sask |
| 2003/0070809 | A1 | 4/2003 | Schultz et al. |
| 2003/0075324 | A1 | 4/2003 | Dusterhoft et al. |
| 2003/0121663 | A1 | 7/2003 | Weng et al. |

OTHER PUBLICATIONS

J. M. Dees, et al., "Horizontal Well Stimulation Results in the Austin Chalk Formation, Pearsall Field, Texas", SPE 20683, 65$^{th}$ Annual SPE Technical Conference, Sep. 23-26, 1990, pp. 665-676, New Orleans, LA.

T. E. Krawletz and E. L. Rael, "Horizontal Well Acidizing of a Carbonate Formation: A Case History of Lisburne Treatments, Prudhoe Bay, Alaska", SPE Production and Facilities, Nov. 1996, pp. 238-243.

R. L. Nelson, et al., "Multiple Pad-Acid Fracs in a Deep Horizontal Well", SPE 39943, 1998 SPE Rocky Mountain Regional/Low-Permeability Reservoirs Symposium, Apr. 5-8, 1998, pp. 363-373, Denver, CO.

L. P. Prouvost and N. Doerler, "Chapter 15: Fluid Placement and Diversion in Sandstone Acidizing", *Reservoir Stimulation*, 1989, pp. 15-1-15-9, Second Edition, Prentice Hall, New Jersey.

L. P. Prouvost and M. J. Economides, "Chapter 16: Matrix Acidizing Treatment Evaluation", *Reservoir Stimulation*, 1989, pp. 16-1-16-8, Second Edition, Prentice Hall, New Jersey.

European Search Report No. 112484 for 2005UR007, dated Aug. 4, 2005, 3 pages.

PCT International Search Report and Written Opinion for 2005UR007, mailed Aug. 29, 2006, 8 pages.

PCT International Preliminary Report on Patentability for 2005UR007, mailed May 7, 2007, 10 pages.

HYDRAULICALLY CONTROLLED BURST DISK SUBS AND METHODS FOR THEIR USE

This application is the National Stage of International Application No. PCT/US06/04967, filed 10 Feb. 2006, which claims the benefit of U.S. Provisional Application No. 60/663,216, filed on Mar. 18, 2005.

BACKGROUND

This section is intended to introduce the reader to various aspects of art, which may be associated with exemplary embodiments of the present invention, which are described and/or claimed below. This discussion is believed to be helpful in providing the reader with information to facilitate a better understanding of particular techniques of the present invention. Accordingly, it should be understood that these statements are to be read in this light, and not necessarily as admissions of prior art.

Oil companies have been drilling and completing horizontal wells for over a decade. Many of these wells include long horizontal carbonate pay sections that require acid stimulation treatments to produce commercial rates.

Acid fracturing is a common method of well stimulation in which acid, typically hydrochloric acid, is injected into a reservoir with sufficient pressure to either fracture the formation or open existing natural fractures. Portions of the fracture face are dissolved by the acid flowing through the fracture. Effectiveness of the stimulation is determined by the length of the fracture which is influenced by the volume of acid used, its reaction rates, and the acid fluid loss from the fracture into the formation.

These horizontal wells typically require pre-drilled holes in the liners to facilitate fluid interval stimulation. The acid or simulation fluid needs to be diverted away from the holes after the interval is treated to additional sections that are intended to be treated.

Some wells are completed by spacing out pre-drilled holes along the un-cemented liner section. Effective placement of the acid treatment along the long horizontal section is operationally challenging. Currently, ball sealers along with the limited-entry perforating technique are used to divert the stimulation fluids. Conventional means of increasing stimulation interval coverage include dividing the lateral into smaller sections through use of bridge plugs and packers which increases completion cost and mechanical complexity.

One common prior art completion technique is often referred to as the open hole "Sprinkler System." The system consists of running a pre-perforated, un-cemented liner in open hole and stimulating down the casing at the highest rate possible while remaining within the pressure ratings of the casing. Acid diversion along the entire lateral length is achieved by a combination of limited entry perforating, high injection rates and the use of ball sealers to plug off a portion of existing perforations and divert flow through other perforations. This technique is limited by the inability to select which perforations the ball sealers will seal. Subsequent production logs such as, radioactive tracer and temperature logs indicate that the entire lateral may only be partially treated with this technique with questionable true fracture extension away from the wellbore. This can present a challenge in maximizing recovery in a reservoir.

A method to improve the fracture geometry involves reducing the length of the lateral being treated while maintaining similar injection rates. This can be achieved by drilling shorter laterals or by dividing a long lateral into several sections and treating each independently. Treating smaller lateral sections effectively increases the rate per foot of reservoir being stimulated and can significantly increase the fracture geometry and improve ultimate performance. While drilling shorter laterals typically improves stimulation performance, it also typically increases costs as additional wells may be required to effectively deplete the reservoir. Therefore, segmenting longer laterals for stimulation purposes is a logical next step.

Recent improvements in open-hole packer technology provide the ability to mechanically isolate long laterals into separate shorter intervals and selectively stimulate each section. This "packer plus technology" is a mechanical diversion technique utilizing packers and bull plugs (kobes) to seal off perforations, and the travelling sub to knock off the bull plugs. This technique limits the treatment from the bottom up or from toe to heel in a horizontal interval.

To accomplish this, an open-hole anchor packer and a series of open hole mechanical set packers are run into the lateral section on drill pipe as part of the liner. The system is then spaced out as required to separate the targeted stimulation intervals. On top of the assembly, a hydraulic set liner top packer and setting tool is run and spaced out to land in the casing. Each packer is pinned to set at increasing hydraulic pressures starting from the bottom up. A pump out plug or ball seat is consecutively run downstream of the deepest packer to provide the seal necessary to induce internal pressure.

When on bottom, an open-hole anchor is set with hydraulic pressure down the drill pipe. The anchor is pinned to shear and set at a predetermined pressure which can be detected on the surface monitoring equipment. After setting the anchor, the down-hole pressure is bled off and compression pressure is slacked off onto the anchor before the remaining packers are set. This locks the liner in compression and prevents movement of the isolation packers while pumping the stimulation fluid due to temperature shrinkage. Each subsequent packer is consecutively set with increasing hydraulic pressures. Typical setting ranges for example, may be 8,620 Kilo Pascal (KPa) (1250 pressure per square inch (psi)), 10,300 KPa (1500 psi), 12,100 KPa (1750 psi) and 13,800 KPa (2000 psi). After all the packers have been successfully set and the annulus tested, right hand torque releases the setting tool and the drill pipe is recovered from the well. After recovery of the drill pipe, the drilling rig may be rigged down and moved off location in preparation for the stimulation.

The toe section of the liner system may be pre-perforated with holes spaced out as in the typical "Sprinkler System" design. Between the packers are a series of ported subs that are blanked off with small bull plugs (or kobes) that intrude into the internal diameter of the liner. A sub is a short length of pipe that is threaded on both ends with special features described above. These subs may be spaced out every $2^{nd}$ or $3^{rd}$ casing joint to cover the entire section. A traveling sub containing a ball seat is pinned just downstream of each open hole packer and is activated during the stimulation by dropping a large composite ball. This ball is pumped down the casing and into the liner until it reaches the corresponding seat. After seating, the pressure begins to rise until the traveling sub shears from the packer and begins sliding concentrically down the casing. This sub then knocks off each of the kobes in order exposing the frac ports. When the sub reaches the other end, it latches into the top of the lower packer and creates an inner and outer seal to prevent continued stimulation of the lower interval. The well is now configured to stimulate the middle interval without ever stopping the pumps. When this second stage treatment has been pumped, a slightly larger ball is dropped to expose the frac ports in the upper section and isolate from the middle interval. After clearing the frac equipment, the well is put on test and the balls flowed off seat and recovered at the surface.

A potential economic benefit exists from improving the acid frac stimulation effectiveness in some horizontal completions. Typical completion techniques span a wide range of cost and complexity and can have a significant impact on the economics of the project. As discussed above, one method to maximize the benefit of high treating rates to create fracture geometry involves mechanically separating open-hole laterals into several sections and treating each zone independently. Unfortunately, this technique has proven costly, slow and subject to high mechanical risk.

Further, other methods may involve coupling burst disk assemblies together along intervals of a wellbore and treating the intervals in a sequential manner from the toe to the heel or heel to the toe. See Intl. Appl. Pub. No. WO 03/056131. In the method, burst disk assemblies are utilized to treat individual intervals in a sequential manner from the toe to the heel or heel to the toe to allow pressure to build up for the following intervals. However, this method does not describe treating the production intervals with the most potential with the first treatment.

Accordingly there is a need to improve stimulation coverage while maximizing completion value. Preferably, this method would comprise an open hole mechanical isolation system and methodology to selectively stimulate separate intervals within a single lateral. This invention satisfies that need.

Other related material may be found in at least U.S. Pat. Nos. 3,637,020; 4,949,788; 5,005,649; 5,145,005; 5,156,207; 5,320,178; 5,355,956; 5,392,862; 5,950,733; 6,173,795; 6,189,618; U.S. Patent App. Pub. No. 2003/0070809; U.S. Patent App. Pub. No. 2003/0075324; and Intl. Appl. Pub. No. WO 03/056131. Further, additional information may also be found in Economides et al., Reservoir Simulation, Second Edition, 15-1 to 17-12 (1989); Dees et al., "Horizontal Well Stimulations Results in the Austin Chalk Formation, Pearsall Field, Tex.", SPE 20683 (1990); Nelson et al., "Multiple Pad-Acid Fracs in a Deep Horizontal Well", SPE 39943 (1998); Krawletz et al., "Horizontal Well Acidizing of a Carbonate Formation: A Case History of Lisburne Treatments Prudhoe Bay, Ala.", SPE Production & Facilities 238-243 (1996).

SUMMARY

In one embodiment, a wellbore apparatus is disclosed. The wellbore apparatus comprises a three-dimensional tubular element capable of fluid flow in a wellbore and a at least one burst disk with a pre-determined pressure rating positioned at a desired location on the tubular wherein the burst disk ruptures at the pre-determined pressure at the desired location on the tubular in the wellbore.

In a second embodiment a method for treating a subterranean section surrounding a wellbore with a fluid comprising is disclosed. The method comprises a) providing a tubular member capable of fluid flow in a wellbore with at least one burst disk with a predetermined pressure rating, b) increasing the pressure inside the tubular member until at least one burst disk ruptures at the predetermined pressure, c) treating the subterranean section surrounding the ruptured burst disk with a fluid by flowing the fluid through the ruptured burst disk.

A third embodiment is disclosed and is similar to the second embodiment but further comprises a) sealing at least one ruptured burst disk with a ball sealer, b) increasing the pressure inside the tubular to rupture a second burst after at least one ruptured burst disk is sealed, c) treating the subterranean section surrounding the second ruptured burst disk with a fluid by sending the fluid through the ruptured burst disk, and d) repeating steps (a) through (c) until all desired subterranean intervals have been treated with a fluid.

A fourth embodiment is disclosed and is similar to the first embodiment. In this embodiment, a wellbore apparatus is described that includes a) a three-dimensional tubular element capable of fluid flow in a wellbore; b) a first set of openings and a second set of openings within the three-dimensional tubular element; c) at least one burst disk with a pressure rating positioned at a location within the three-dimensional tubular element between the first set of openings and the second set of openings, wherein the at least one burst disk is adapted to rupture at the pressure during well treatment at the location on the three-dimensional tubular element in the wellbore.

A fifth embodiment is disclosed of a method for treating a subterranean section surrounding a wellbore with a fluid. The method includes a) providing a tubular member capable of fluid flow in a wellbore and having a plurality of burst disks, each of the plurality of burst disks with a pressure rating, wherein at least three of the plurality of burst disks are located at different intervals in the subterranean section and have different pressure ratings; b) increasing the pressure inside the tubular member until at least one of the plurality of burst disks ruptures at a predetermined pressure; c) treating the subterranean section surrounding the ruptured at least one of the plurality of burst disks based on productivity of each of the different intervals with a fluid by flowing the fluid through the ruptured the at least one of the plurality of burst disks; d) repeating steps b) and c) until each of the plurality of burst disks have been ruptured in an order based on productivity of each of the different intervals.

A sixth embodiment is disclosed of a well system. The well system includes a three-dimensional tubular element adapted for fluid flow in a wellbore; a plurality of openings in the three-dimensional tubular element, wherein the plurality of openings are positioned adjacent different intervals within the wellbore; a first burst disk with a first pressure rating positioned at a first location associated with a first portion of the plurality of openings on the three-dimensional tubular element, wherein the first burst disk ruptures at the first pressure to provide well treatment at the first location on the three-dimensional tubular element in the wellbore; and a second burst disk with a second pressure rating positioned at a second location associated with a second portion of the plurality of openings on the three-dimensional tubular element, wherein the second burst disk ruptures at the second pressure to provide well treatment at the second location on the three-dimensional tubular element in the wellbore.

A seventh embodiment is disclosed of a method for treating subterranean sections surrounding a wellbore with a fluid. The method includes: providing a tubular member capable of fluid flow in a wellbore with a first burst disk with a first pressure rating and a second burst disk with a second pressure rating; treating a first subterranean section with a fluid by flowing the fluid through a first plurality of openings in the tubular member; increasing the pressure inside the tubular member until the first burst disk ruptures; treating a second subterranean section surrounding the ruptured first burst disk with a fluid by flowing the fluid through a second plurality of openings in the tubular member exposed by the ruptured first burst disk; increasing the pressure inside the tubular member until the second burst disk ruptures; and treating a third subterranean section surrounding the ruptured second burst disk with the fluid by flowing the fluid through a third plurality of openings in the tubular member exposed by the ruptured second burst disk.

DETAILED DESCRIPTION

In the following detailed description, the invention will be described in connection with its preferred embodiments. However, to the extent that the following description is specific to a particular embodiment or a particular use of the invention, this is intended to be illustrative only. Accordingly, the invention is not limited to the specific embodiments described below, but rather, the invention includes all alternatives, modifications, and equivalents falling within the true scope of the appended claims.

The goal of any completion is to maximize value over the life of the well. The concept of maximizing value means optimizing capital investment and operating expense against well productivity or infectivity over the well life cycle to achieve maximum profitability. The Hydraulically Controlled Burst Disk Subs (HCBS) improves stimulation coverage thereby assisting in the goal to maximize completion value.

Figure 1:
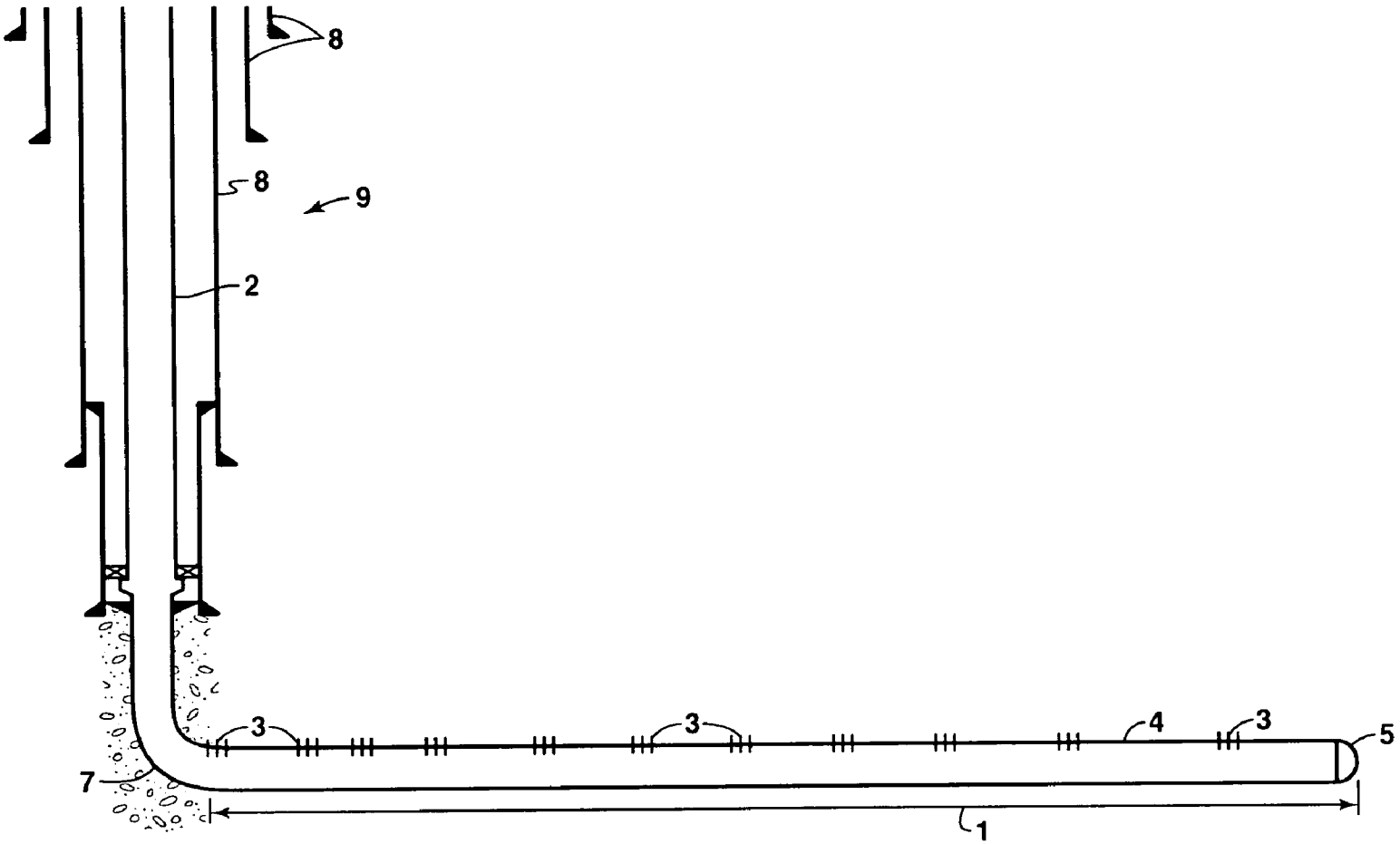
FIG. 1 (Prior Art)
FIG. 1 is an illustration of a typical horizontal well completion with nested casings.

FIG. 1 is an example of a horizontal well completion from a main wellbore 2 with nested casings 8. The approximately 1.2 Km (4,000 ft) long horizontal carbonate pay section 1 requires acid stimulation treatments to produce commercial rates. The section of horizontal liner 4 begins at the bend or heel 7 at the end of the main vertical interval of the wellbore 2 and ends with a toe 5 that is used to seal the end of the liner 4. In this example, at least one well 9 is completed by spacing out approximately 20 sets of ⅜-inch pre-drilled holes (openings) 3 (three holes per set at 120 degrees phasing) along the un-cemented section of liner 4. Effective placement of the acid treatment along the long horizontal pay zone section 1 is operationally challenging when using this configuration.

One embodiment of the inventive method replaces at least one of the sets of pre-drilled holes in the liner with burst disks. This "Burst Disk Apparatus and Method" provides the ability to treat the well from the heel down to the toe. In one embodiment, the Burst Disk Apparatus is a wellbore apparatus comprising a hollow three-dimensional tubular element capable of fluid flow in a wellbore (or casing) with at least one burst disk with a pre-determined pressure rating positioned at a desired location on the tubular wherein the burst disk ruptures at the pre-determined pressure at the desired location on the tubular in the wellbore.

Figure 2:
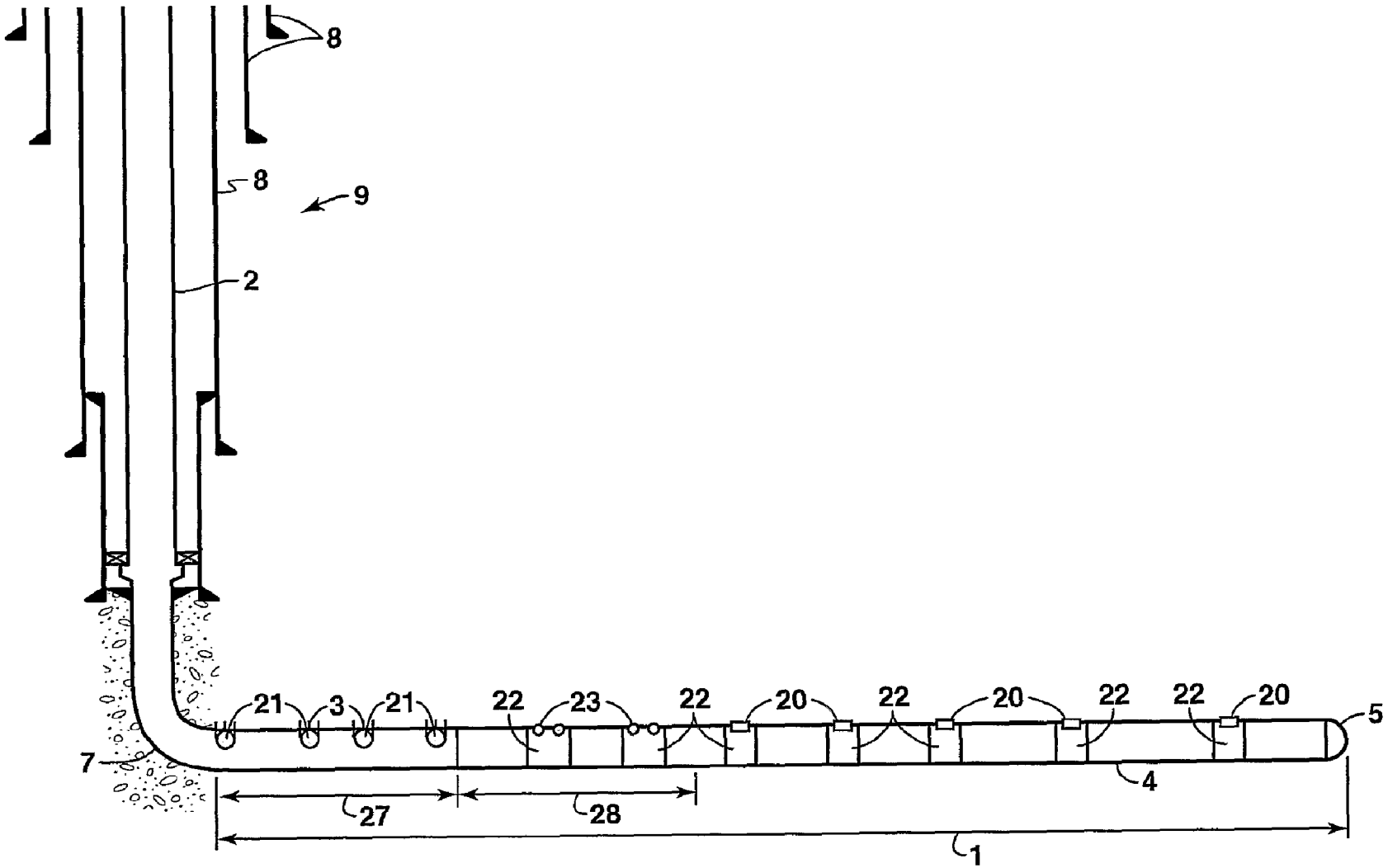
FIG. 2 is an illustration of a horizontal well completion with perforated subs and burst disks.

FIG. 2 is an illustration of an embodiment of the invention that is similar to illustration of FIG. 1 in which the like elements to FIG. 1 have been given like numerals. As shown in FIGS. 1 and 2 the pre-drilled holes 3 in the horizontal liner 4 of FIG. 1 have been replaced with perforated subs 22 with burst disks 20 in FIG. 2.

Figure 3A:
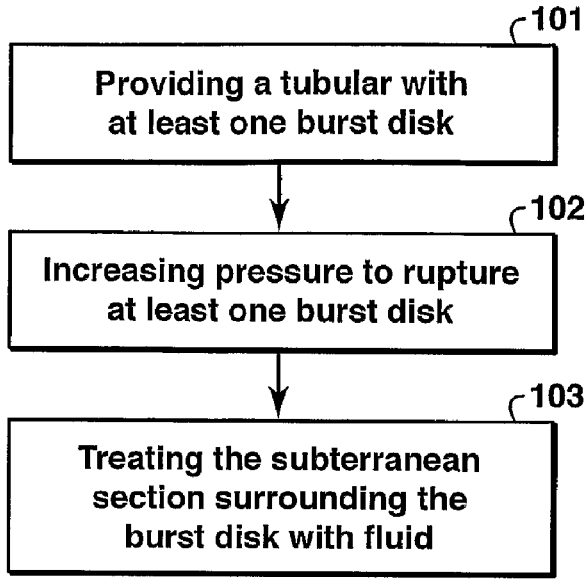
FIG. 3A is a flow chart of a first embodiment of the inventive method.

FIG. 3A is a graphical flow chart illustrating a first embodiment of the inventive method. As shown in FIG. 3A, a tubular with at least one burst disk is installed in a wellbore 101. After the tubular is installed pressure is increased to rupture at least one burst disk 102. The subterranean section surrounding the ruptured burst disk is treated with a fluid 103.

Figure 3B:
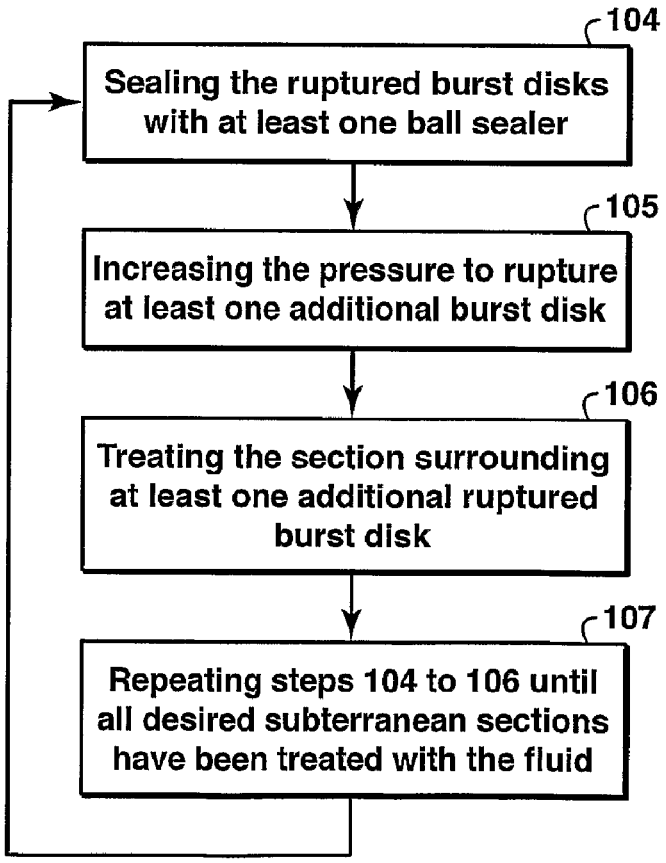
FIG. 3B is a flow chart of a second embodiment of the inventive method.

FIG. 3B is a graphical flow chart illustrating a second embodiment of the inventive method that is a continuation of the first embodiment as illustrated in FIG. 3B. In this embodiment, the ruptured burst disks are sealed with at least one ball sealer 104. After at least one ruptured burst disk is sealed, the pressure is increased to rupture at least one additional burst disk 105. The section surrounded the at least one additional ruptured burst disks is treated with a fluid 106. The previous three steps (step 104-106) are repeated, if necessary, until all desired subterranean section have been treated with the fluid 107.

In the embodiment illustrated in FIG. 2, all burst disks 20 are eventually opened in this technique. However, each set of perforated subs 22 is initially isolated by an intact burst disk 20. This configuration can also be referred to as Hydraulically Controlled Burst Disk Subs ("HCBS"). The HCBS is a short section of tubular on which pre-drilled holes have been plugged off by installed burst disks. The burst disks will be opened at a pre-determined pressure.

As shown in FIG. 2, after pumping the treatment fluid into the first set of perforations, the ball sealers 21 will be dropped to seal off the perforations or pre-drilled holes 3. The wellbore will be pressured up to break at least one isolation burst disks to create at least one ruptured disk perforation 23. After the first set of burst disks 22 have been ruptured, the ruptured burst disk perforations 23 are typically treated with pumped pressurized fluid. At the end of the treatment of the first set of ruptured burst disk perforations 23, ball sealers 21 can be dropped to seal off the first set of ruptured disk perforations 23 and break open the second set of burst disks and so on. This technique provides the ability to eliminate any downhole moving parts.

Figure 4:
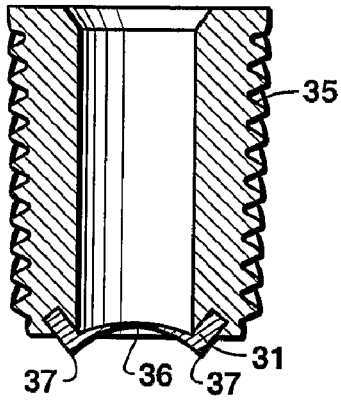
FIG. 4 is an illustration of a typical burst disk.

FIG. 4 is an illustration of a typical commercially available burst disk. A burst disk 31 is typically held in place through the use of an external threaded connector 35. The burst disk comprises a relatively high strength outer section with a thick wall 37 that is unlikely to burst and a weaker thinner section 36 that is designed to burst at a pre-determined pressure. Typically, the thinnest and thus weakest section 36 is in the middle of the burst disk. The burst disk material should be suitable for the well environment and resistant to hydrochloric acid. The net cost impact of the perforated subs and burst disks is expected to be minimal.

Figure 5:
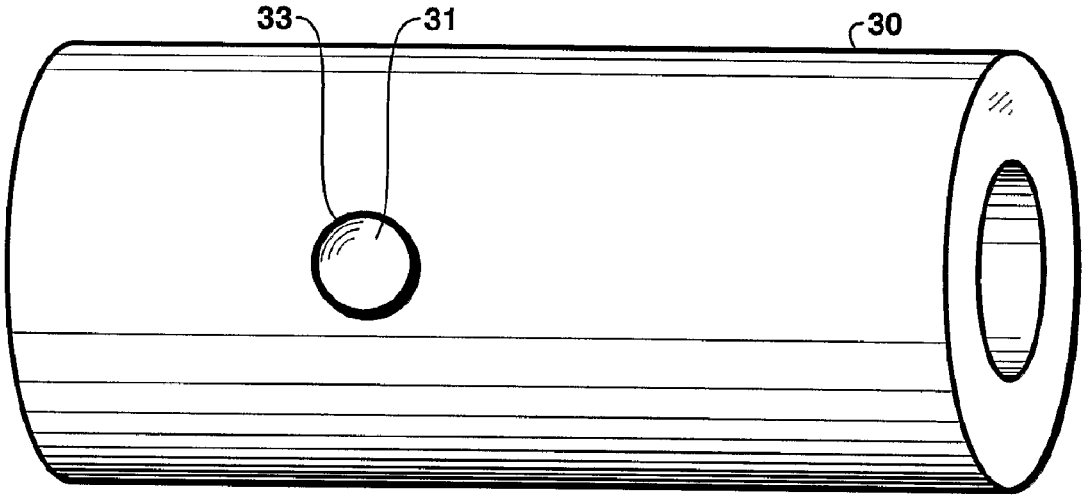
FIG. 5 is a cross-sectional illustration of a burst disk on a casing.

FIG. 5 is an illustration of a burst disk 31 on a casing 30. In this example, the burst disks 31 are held in place for example by threaded couplings 33 that are recessed in the casing 30 string. The burst disks 31 can be designed to burst at predetermined hydraulic pressures along the length of the horizontal. In one embodiment, each successive burst disk has a higher pressure rating along the length of the interval. The purpose of each successive burst disk having a higher pressure rating is to provide for the ability to rupture the burst disks sequentially by simply continuously raising the pressure.

Now referring to FIG. 2, ball sealers 21 can be used to isolate the zones 27 being treated and to develop net hydraulic pressure. The net hydraulic pressure will open a new interval zone 28 by rupturing disks with higher pressure ratings to create ruptured disk perforations 23. The sizes and pressure ratings of burst disks required for this type of application are commercially available.

In one embodiment, a 1,200 meter (4,000 feet (ft)) un-cemented horizontal liner section similar to FIG. 2 could be run from heel to toe as follows: 600 meter (2,000 ft) of liner with ten sets of pre-drilled holes and 600 meter (2,000 ft) of liner with ten HCBS. The first 300 meter (1000 ft) of HCBS may, for example, be set to open at 3.45 KPa (500 psi) higher than a predetermined treating pressure. The last 300 meter (1,000 ft) liner with HCBS may, for example be set to open at 6.89 KPa (1000 psi) higher than a predetermined treating pressure. The build up pressure in the wellbore can be achieved by increasing net pressure during the stimulation or from ball sealers plugging the pre-drilled holes.

In a second embodiment, the liner initially contains pre-drilled holes along with burst disks. In this embodiment, ball sealers may be utilized to seal off all existing perforations, and then new perforations will be opened through rupturing burst disks. Since all the old perforations are sealed off, treatment fluid will divert to new burst disks or perforations, as designed.

Depending on the specific well requirements, pre-drilled holes in the liner and HCBS can be run in any order. For example, the pre-drilled holes will be set across the most productive interval along the lateral. The lowest pre-determined burst disk pressure will be set across the second most productive interval, and so on.

Figure 6:
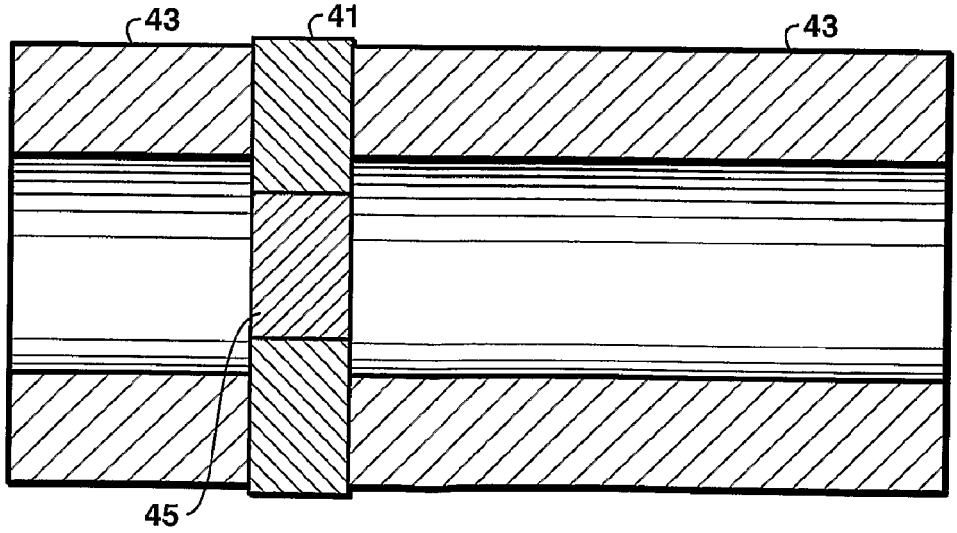
FIG. 6 is a cross-sectional illustration of a burst disk between two joints of casing.

A third embodiment of the burst disk technology involves dividing the wellbore liner (or tubular lateral section) into at least two section and preferably into as many sections as required to achieve a favorable stimulation of the reservoir. Each section may be isolated by inserting a burst disk assembly between two tubular joints. For example, FIG. 6 is a cross-section illustrating a burst disk assembly 41 housing a burst disk 45 attached to a casing between two joints of casing 43. In one embodiment, the burst disk and the burst disk assembly are held in place by threaded couplings but other methods can be utilized to attach the burst disk 45 to the burst disk assembly 41 and the burst disk assembly 41 to the casing 43.

Figure 7:
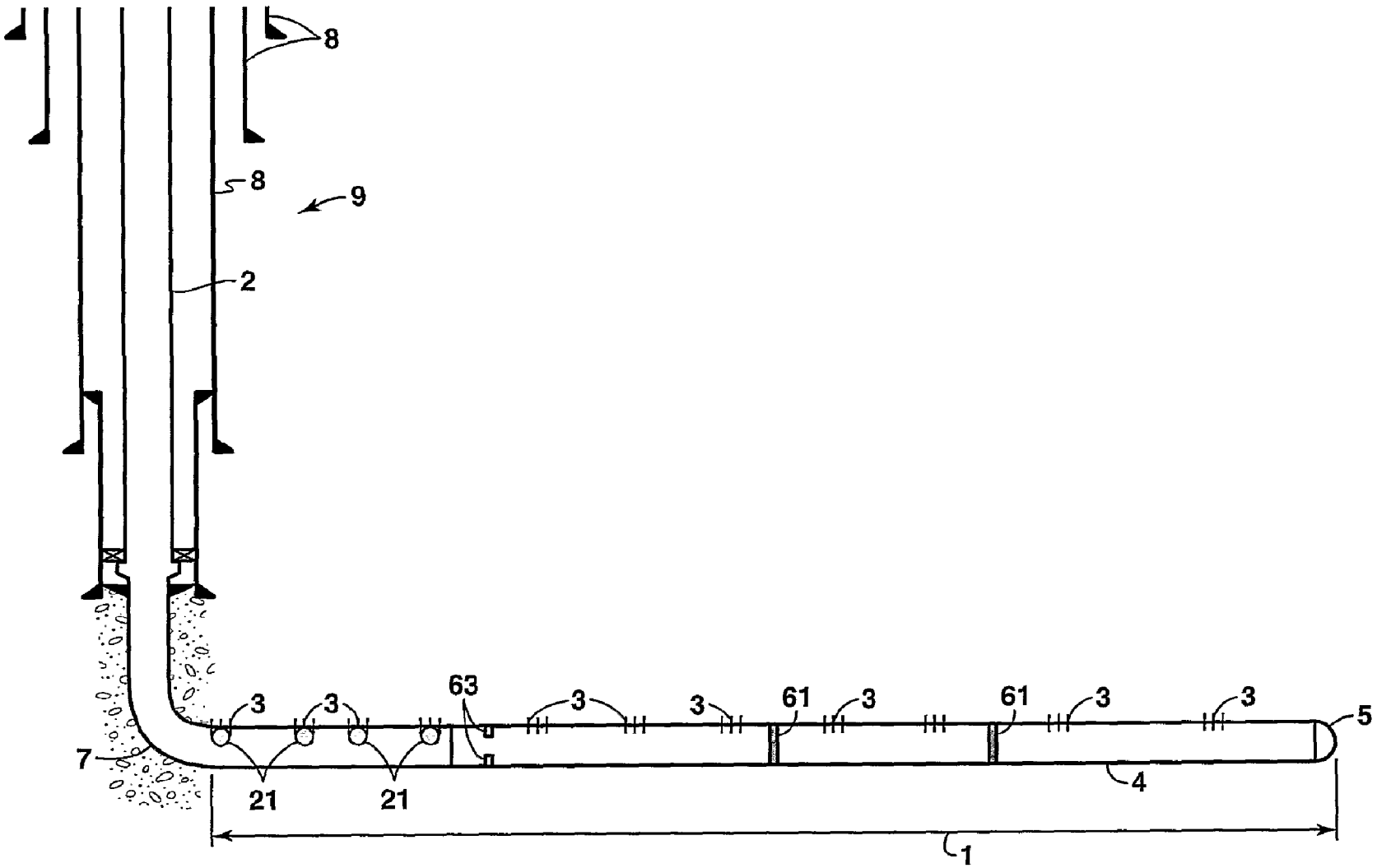
FIG. 7 is a cross-sectional illustration of a typical horizontal well completion with perforated subs and burst disks.

FIG. 7 illustrates the burst disk assembly concept in a well completion that is similar to FIG. 2 in which the like elements to FIG. 2 have been given like numerals. This figure illustrates two intact burst disk assemblies 61 and one ruptured burst disk assembly 63 inside the casing 4.

The burst disks may be ruptured at predetermined differential pressure ranges thus allowing each lateral section to be treated sequentially. The placement of the burst disks permits the wellbore to be treated from the heel to the toe without the necessity of burst disks on the outer wall of the casing. Therefore, the outer wall of the liner can be left with open predrilled holes or with burst disks of relatively uniform pressure ratings. In addition, the interval can be treated sequentially from heel to toe by having the burst disk rupture sequentially by increasing the pressure. Conversely, the interval can be treated from toe to heel by having the pressure ratings of the burst disks on the outer wall increase from toe to heel. The fluid treatment order of the various intervals can be controlled by increasing the pressure ratings of the burst disks based on the location on the liner to correspond to the desired interval treatment sequence.

In a second embodiment, the liner initially contains pre-drilled holes along with burst disks. In this embodiment, ball sealers may be utilized to seal off all existing perforations, and then new perforations will be opened through rupturing burst disks. Since all the old perforations are sealed off, treatment fluid will divert to new burst disks or perforations, as designed.

A fourth embodiment is a modified packer plus technique. In this embodiment hydraulic pressure is utilized to break the burst disks instead of using a travelling sub to open new perforations. The proposed technique eliminates the necessity of a travelling sub and thus can simplify downhole equipment design. In one embodiment, the interval at the heel is open with pre-drilled holes. The next interval, from the heel, will be equipped with HCBS with a pre-determined pressure 500 psi higher than the expected treating pressure. The next interval, third from the heel, will be equipped with HCBS with opening pressure set at 1000 psi above treating pressure. Additional HCBS can be added with consecutively increasing pressure ratings. The liner is treated from the heel, one interval at a time. After each interval is treated the interval is sealed with ball sealers and the next interval is treated by opening the burst disks by increase treating pressure. Each interval can thus be treated consecutively by increasing the treating pressure.

This technique offers flexibility to achieve a favorable treatment order along the completion interval or pay section. If the set of perforations in the middle of the pay zone need to be treated first, the perforation in the middle of the tubular can be open or a set of burst disk(s) can be inserted to rupture at a low pressure. After pumping the first set of perforations, ball sealers may be launched to seal off the perforations. The next set of burst disks can be set anywhere along the pay zone. For example, if the "heel" area needs to be treated, wellbore pressure can be increased to break the burst disk at the heel for fluid treatment. Additional ball sealers can be deployed to seal off the perforations and pressure up to break the next set of burst disks. The same process is repeated until all desired pay sections are treated. This technique allows the option of treating the most important set of perforations first rather than having to treat the bottom set of perforations first. The HCBS can be placed to eliminate the need to employ any moving mechanical downhole parts and thus can increase mechanical simplicity with anticipated cost savings.

This technique can simplify the equipment that needs to be installed downhole. The technique provides the ability to reduce internal diameter restriction and can minimize debris left in the hole associated with PackerPlus system. Cleaner wellbore would enable quicker clean out with coiled tubing and production logging run for assessing well performance.

EXAMPLE

In an example using the embodiment described previously a 1,200 meters (4,000 ft) un-cemented horizontal liner could be run as follows (heel to toe): 600 meters (2,000 ft) of liner with ten sets of pre-drilled holes, burst disk assembly, 300 meters (1,000 ft) of liner with five sets of pre-drilled holes, burst disk assembly, and 300 meters (1,000 ft) of liner with five sets of pre-drilled holes. The first burst disk can be set to open, for example, at 3,450 KPa (500 psi) higher than a predetermined treating pressure. The next burst disk can be set to open 16900 KPa (1000 psi) higher than a predetermined treating pressure. The build up pressure in the wellbore can be achieved by increasing net pressure during the stimulation or from ball sealers seating on the pre-drilled perforations.

We claim:

1. A wellbore apparatus comprising;

a) a three-dimensional tubular element capable of fluid flow in a wellbore, wherein the three-dimensional tubular element is divided into at least two sections of casing with each of the sections having ends;

b) a first set of openings and a second set of openings within the three-dimensional tubular element;

c) a burst disk with a pressure rating positioned at a location within the three-dimensional tubular element between the first set of openings and the second set of openings, wherein the burst disk blocks the flow of well treatment to the second set of openings while intact, and is adapted to rupture at the rated pressure during well treatment to provide a flow path for the well treatment to the second set of openings and is positioned between the two ends of the adjacent sections of the three-dimensional tubular element.

2. The wellbore apparatus of claim 1 wherein the first set of openings and the second set of openings are predrilled holes in the three-dimensional tubular element.

3. The wellbore apparatus of claim 1 further comprising a ball sealer within the three-dimensional tubular element adapted to seal the first set of openings prior to increasing the pressure to rupture the burst disk.

4. A method for treating subterranean sections surrounding a wellbore with a fluid comprising:

providing a tubular member capable of fluid flow in a wellbore, wherein the three-dimensional tubular element is divided into at least two sections of casing with each of the sections having ends; wherein the tubular member comprises a first set of openings and a second set of openings within the three-dimensional tubular element; and wherein the tubular member further comprises a burst disk with a pressure rating positioned at a location within the three-dimensional tubular element between the first set of openings and the second set of openings, wherein the burst disk blocks the flow of well treatment to the second set of openings while intact, and is adapted to rupture at the rated pressure during well treatment to provide a flow path for the well treatment to the second set of openings and is positioned between the two ends of the adjacent sections of the three-dimensional tubular element;

treating a first subterranean section with a fluid by flowing the fluid through the first set of openings in the tubular member;

increasing the pressure inside the tubular member until the burst disk ruptures; and treating a second subterranean section with a fluid by flowing the fluid through the second set of openings in the tubular member exposed by the ruptured burst disk.

5. The method of claim 4 further comprising dropping at least one ball sealer into the tubular member prior to increasing the pressure inside the tubular member, wherein the at least one ball sealer is adapted to seal the first set of openings in the tubular member.

* * * * *